US010816273B2

(12) United States Patent
Ipposhi et al.

(10) Patent No.: US 10,816,273 B2
(45) Date of Patent: Oct. 27, 2020

(54) BOILING COOLING DEVICE AND BOILING COOLING SYSTEM

(71) Applicant: Mitsubishi Electric Corporation, Chiyoda-ku (JP)

(72) Inventors: Shigetoshi Ipposhi, Tokyo (JP); Masaru Shinozaki, Tokyo (JP); Yugo Asai, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 154 days.

(21) Appl. No.: 15/781,568

(22) PCT Filed: Jan. 8, 2016

(86) PCT No.: PCT/JP2016/050450

§ 371 (c)(1),
(2) Date: Jun. 5, 2018

(87) PCT Pub. No.: WO2017/119113

PCT Pub. Date: Jul. 13, 2017

(65) Prior Publication Data

US 2020/0018554 A1 Jan. 16, 2020

(51) Int. Cl.
*F28D 15/00* (2006.01)

(52) U.S. Cl.
CPC ..... *F28D 15/00* (2013.01); *F28F 2250/08* (2013.01)

(58) Field of Classification Search
CPC ..... F28D 15/00; F28D 15/0258; F28D 21/00; F28F 2250/08; F25B 23/006
See application file for complete search history.

(56) References Cited

U.S. PATENT DOCUMENTS

2005/0279491 A1* 12/2005 Thorne ..... F28D 15/0266 165/272
2012/0167601 A1* 7/2012 Cogswell ..... F25B 1/10 62/115

FOREIGN PATENT DOCUMENTS

| | | | |
|---|---|---|---|
| JP | 2001-35980 A | | 2/2001 |
| JP | 2004-349551 A | | 12/2004 |
| JP | 2005-118542 A | | 5/2005 |
| JP | 2005-164126 A | | 6/2005 |
| JP | 2008202812 A | * | 9/2008 |

OTHER PUBLICATIONS

JP-2008202812-A translation.*
International Search Report dated Mar. 22, 2016 in PCT/JP2016/050450 filed Jan. 8, 2016.

* cited by examiner

*Primary Examiner* — Elizabeth J Martin
(74) *Attorney, Agent, or Firm* — Xsensus LLP

(57) ABSTRACT

A boiling cooling device and a boiling cooling system which can promote boiling and restrain the cooling capacity of the device from deteriorating. A boiling cooling device includes: a pump to circulate refrigerant; a microbubble generator to produce microbubbles and incorporate the microbubbles into the refrigerant discharged from the pump; a boiling cooler to which the refrigerant containing the microbubbles is supplied and which boils the refrigerant; a radiator to cool the refrigerant after the refrigerant is boiled and before the refrigerant is taken in by the pump 11; and a gas-liquid separator 15 to separate gas from the circulating refrigerant after the refrigerant is boiled and before the refrigerant is taken in by the pump.

8 Claims, 5 Drawing Sheets

BOILING COOLING DEVICE AND BOILING COOLING SYSTEM

TECHNICAL FIELD

The present invention relates to a boiling cooling device and a boiling cooling system for cooling a heating element using a boiling phenomenon.

BACKGROUND ART

A conventional boiling cooling device is disclosed (refer to Patent Document 1) in which fine spiral grooves are formed of convex and concave portions on an outer surface of a heat transfer tube. Prior Art Document Patent Document Patent Document 1: Japanese Patent Laid-Open Publication No. 2005-164126

SUMMARY OF THE INVENTION

Problems to be Solved by the Invention

In this type of boiling cooling device, for example, when impurities are mixed in the refrigerant, the impurities are condensed by boiling; therefore, continuous use of the device sometimes causes the impurities to precipitate on a heat transfer surface. Then, the heat transfer surface having fine grooves or the like is covered with the precipitated impurities, which hiders the boiling and lowers the cooling capacity.

The present invention is made to solve the above-mentioned problem and to provide a boiling cooling device and a boiling cooling system which can promote occurrence of the boiling and restrain the cooling capacity from being lowered.

Means for Solving the Problem

A boiling cooling device according to the present invention includes: a pump to circulate refrigerant; a microbubble generator to produce microbubbles and incorporate the microbubbles into the refrigerant discharged from the pump; a boiling cooler to which the refrigerant containing the microbubbles is supplied and which boils the refrigerant; a radiator to cool the refrigerant after the refrigerant is boiled and before the refrigerant is taken in by the pump; and a gas-liquid separator to separate gas from the circulating refrigerant after the refrigerant is boiled and before the refrigerant is taken in by the pump.

Also, a boiling cooling system according to the present invention includes: a pump to circulate refrigerant; a microbubble generator to produce microbubbles and incorporate the microbubbles into the refrigerant discharged from the pump; a boiling cooler to which the refrigerant containing the microbubbles is supplied and which boils the refrigerant; a radiator to cool the refrigerant after the refrigerant is boiled and before the refrigerant is taken in by the pump; a gas-liquid separator to separate gas from the circulating refrigerant after the refrigerant is boiled and before the refrigerant is taken in by the pump; and a heating element to be cooled, provided to the boiling cooler.

Effects of the Invention

A boiling cooling device and a boiling cooling system according to the present invention can promote occurrence of boiling and restrain the cooling capacity from being lowered.

EMBODIMENTS FOR CARRYING OUT THE INVENTION

Embodiment 1

Figure 1:
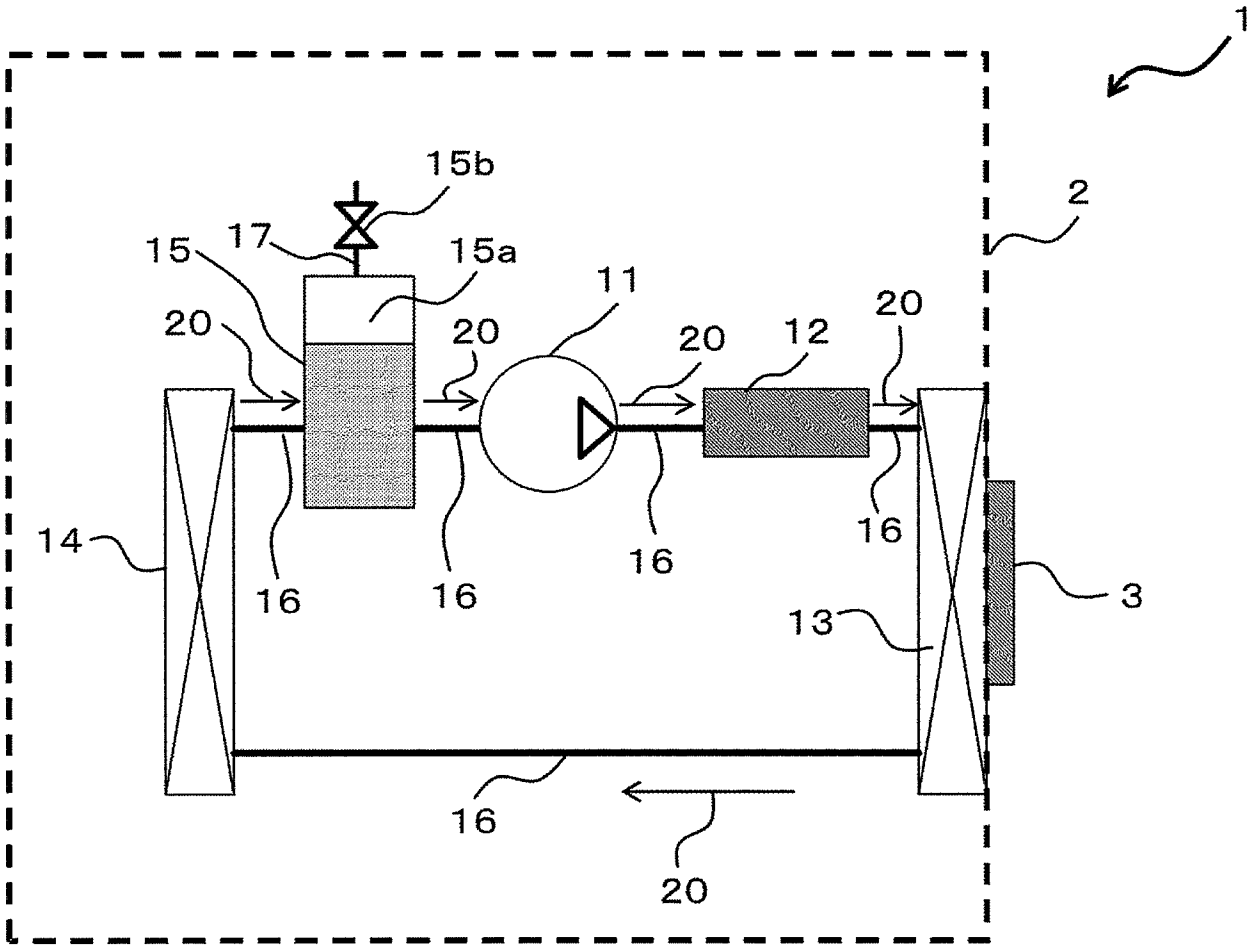
FIG. 1 is a schematic diagram of a boiling cooling system according to Embodiment 1 of the present invention.

A boiling cooling system 1 and a boiling cooling device 2 according to Embodiment 1 of the present invention will be explained with reference to FIG. 1 through FIG. 4. In the drawings, components denoted by the same symbols indicate the same or the equivalent components. This descriptive rule is common to the entire sentences of the specification.

FIG. 1 is a schematic diagram of the boiling cooling system 1 according to Embodiment 1 of the present invention. As shown in FIG. 1, the boiling cooling system 1 according to Embodiment 1 of the present invention mainly includes a pump 11, a microbubble generator 12, a boiling cooler 13, a radiator 14, and a gas-liquid separator 15. Also, each component of the boiling cooling system 1 is connected to other components via refrigerant pipes 16.

As a general cooling system, there is a system for cooling a heating element such as an electronic device installed in a home appliance or a vehicle; and in the cooling system, a pump, a cooler for cooling a heating element, and a radiator are connected in series in this order. In such a cooling system, the pump circulates refrigerant (for example, water); the refrigerant receives heat from a heating element thermally in contact with the cooler; the radiator releases the heat of the refrigerant; whereby the heating element is cooled.

The boiling cooling system 1 according to Embodiment 1 of the present invention especially utilizes a phenomenon that the refrigerant boils in the cooler. When boiling in the cooler, the refrigerant receives more heat in comparison with when not boiling, to promote cooling the heating element 3. Note that, in the boiling cooling system 1 according to Embodiment 1 of the present invention, a boiling phenomenon is used in the cooler and, therefore, the cooler is specially referred to as a boiling cooler 13.

Here, the boiling phenomenon is a phenomenon that vapor bubbles are produced due to a phase change from liquid to vapor (gas). The phase change from liquid to vapor requires a large amount of energy (for example, a large temperature difference between the heat transfer surface of the boiling cooler 13 and the refrigerant, or large pressure waves). That is, vapor bubbles are not necessarily produced when simply applying heat energy to the refrigerant.

Normally, a small amount of gas (foam nucleus) remains in dents (cavities) such as scratches on the heat transfer surfaces. The foam nucleuses are tiny gas bubbles containing air or vapor. Normally, the boiling phenomenon occurs through the foam nucleuses serving as the seeds of vapor bubbles (origins). When a phase change amount (A) from liquid (refrigerant) to vapor through the gas-liquid interface between the liquid and gas becomes imbalanced with a phase change amount (B) from the vapor to the liquid therethrough to reach an A>B state, the foam nucleus volume gets larger (grow) into a larger vapor bubble. As described above, the phase change from liquid to vapor is facilitated by the existence of the foam nucleuses. In the boiling cooling system 1 according to Embodiment 1 of the present invention, the microbubble generator 12 supplies microbubbles to the boiling cooler 13 to promote the boiling, using the microbubbles as the foam nucleuses.

Hereinafter, in order to explain the feature of the boiling cooling system 1 according to Embodiment 1 of the present invention, the boiling phenomenon and each of the components constituting the boiling cooling system 1 will be explained in detail. The boiling cooling system 1 according to Embodiment 1 of the present invention includes the microbubble generator 12 on the upstream side of the boiling cooler 13 in order to promote the refrigerant boiling in the boiling cooler 13. The gas-liquid separator 15 to separate gas from the circulating refrigerant is provided at a position where refrigerant in the boiling cooler 13 has boiled (on the downstream side of the boiling cooler 13) and where refrigerant is not yet taken in by the pump 11.

The pump 11 circulates the refrigerant (refrigerant in a single phase of liquid and refrigerant in two phases of gas and liquid) in the boiling cooling system 1. However, because the gas-liquid separator 15 separates gas from the circulating refrigerant, the refrigerant in the pump 11 is in a liquid state. The pump 11 is a displacement-type pump, a reciprocating-type pump, a rotary-type pump or the like. In choosing the pump 11, a pump is chosen that has a lifting height (pumping capacity) sufficient to circulate the refrigerant at a required flow rate in the boiling cooling system 1.

For the refrigerant, any kind of liquid can be used that boils at a temperature range suitable to cool the heating element 3; therefore, the refrigerant may be, for example, an anti-freezing fluid (for example, a mixture of water and ethylene glycol) or water.

The microbubble generator 12 produces microbubbles and incorporates them with the refrigerant discharged from the pump 11. As shown in FIG. 1, in the boiling cooling system 1 according to Embodiment 1 of the present invention, the upstream side of the microbubble generator 12 is connected to the pump 11 through a refrigerant pipe 16; and the downstream side thereof is connected to the boiling cooler 13 through a refrigerant pipe 16.

The microbubbles produced in the microbubble generator 12 function, as described above, as the foam nucleuses in the boiling cooler 13. Also, the microbubbles have a function to clean dirt owing to an impurity-adsorbing effect or produce pressure waves when ruptured; therefore, the microbubbles can wash off an impurity adhesion layer adhered as scale on the heat transfer surface inside the later-described boiling cooler 13. The microbubbles are, for example, air bubbles that are micrometers in diameter, or preferably between 3 μm to 80 μm in diameter. In a case of a microbubble with its diameter less than 3 μm, the effect of the surface tension prevents the microbubble from suitably growing, which thereby may bring an insufficient effect for the boiling promotion. Also, a microbubble with its diameter larger than 80 m may lower its cleaning effect.

Some microbubble generators 12 do not use liquid flow force while others do. Examples of microbubble generators 12 not using liquid flow force are an ultrasonic type, an electrolytic type, a vapor condensing type, a pore type, and a rotary type. On the other hand, examples of microbubble generators 12 using liquid flow force are a swirling-liquid-flow type, an ejector type and a cavitation type. The microbubble generators 12 using liquid flow force consume no or a small amount of power to produce microbubbles.

In the description of the boiling cooling system 1 according to Embodiment 1 of the present invention, a swirling-liquid-flow-type and an ejector-type microbubble generator 12 will be exemplified in detail as the microbubble generator 12. Hereinafter, a microbubble generator 12 which utilizes the flow of refrigerant to take gas in is referred to as a fluid-flow-type microbubble generator. A swirling-liquid-flow-type microbubble generator 12 and an ejector-type microbubble generator 12 each are a kind of the fluid-flow-type microbubble generator.

The microbubble generator 12 here is not limited to the fluid-flow-type microbubble generator, but a microbubble generator 12 which does not use liquid flow force can also be applied to the present invention. The fluid-flow-type microbubble generator requires no power and is excellent in energy saving; the fluid-flow-type microbubble generator also has no movable portions, no wirings, and no electrical switching controls, which thereby brings high reliability. Another advantageous point is that because the fluid-flow-type microbubble generator produces microbubbles with the devised piping structure, the fluid-flow-type microbubble generator does not require electronic components, which are heat-sensitive, for producing microbubbles. Therefore, the fluid-flow-type microbubble generator is excellent in heat resistance and can flow high-temperature refrigerant. Furthermore, the larger the flow rate, the more microbubbles the fluid-flow-type microbubble generator can produce, thereby supplying more foam nucleuses to the boiling cooler 13.

Figure 2:
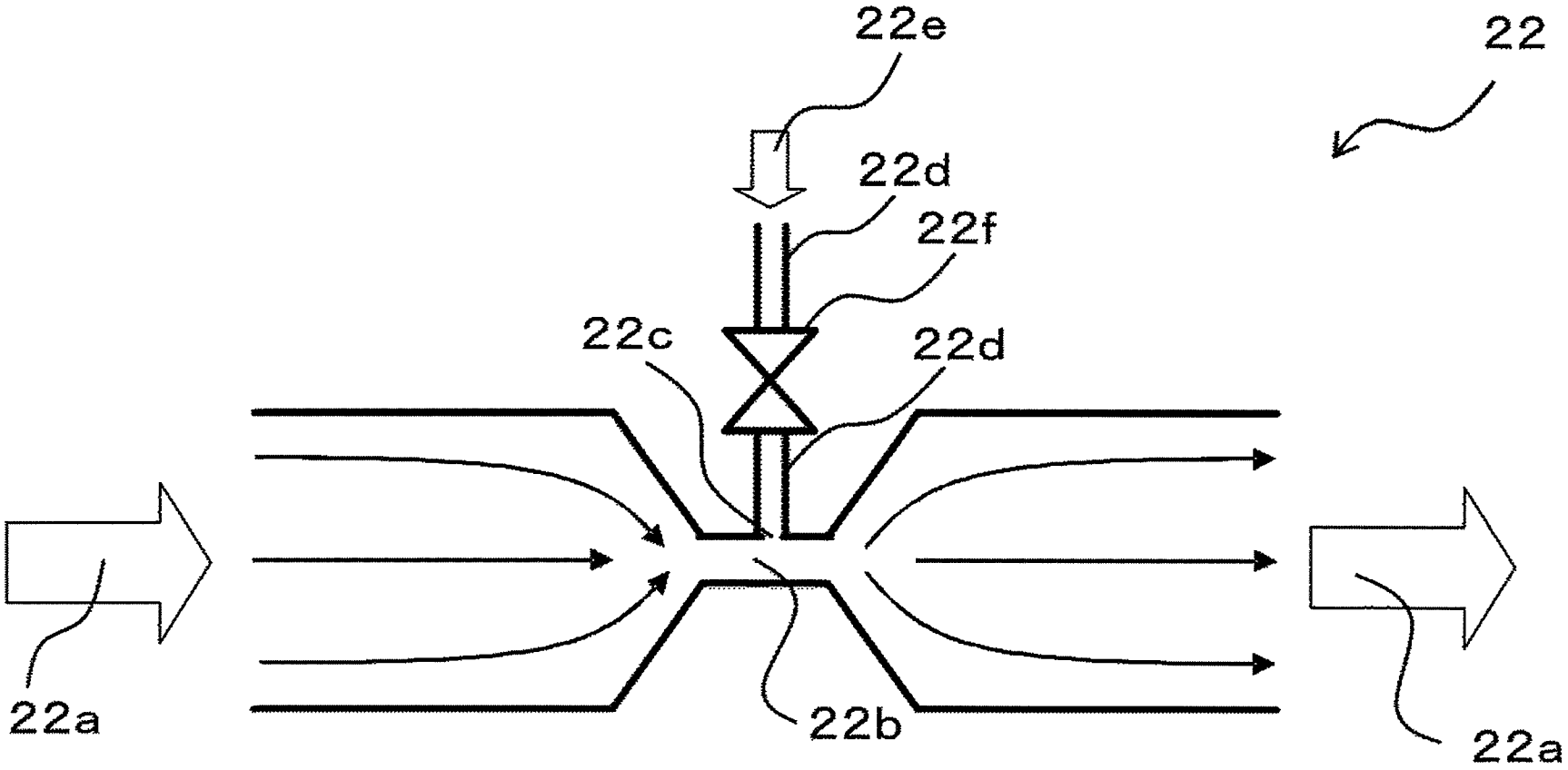
FIG. 2 is a schematic diagram of an ejector-type microbubble generator.

FIG. 2 is a schematic diagram of an ejector-type microbubble generator 22. An ejector type is also called an aspirator. As shown in FIG. 2, in the refrigerant's advancing direction 22*a*, the ejector type includes a narrow section 22*b* which is a narrowed portion of the refrigerant flow path. In FIG. 2, the refrigerant flows from the left side of the sheet to the right thereof. The flow speed at the narrow section 22*b* of the pipe is faster than those at other sections, whereby the pressure (static pressure) is lowered due to the Venturi effect. At the narrow section 22*b* where the static pressure drops, a gas inlet port 22*c* is provided, and an outside-air intake pipe 22*d* is connected to the gas inlet port 22*c*. The microbubble generator 22 takes in surrounding gas (outside air 22*e* such as air) via the outside-air intake pipe 22*d* and mixes the outside air 22*e* and the refrigerant to produce microbubbles. As the result, the refrigerant becomes a two-phase fluid containing the microbubbles.

Note that when, due to for example, stoppage of the pump 11, the refrigerant stops flowing or flows at a speed lower than a normal speed, the static pressure value at the narrow section 22*b* does not drop sufficiently. In that case, the refrigerant may flow in reverse via the outside-air intake pipe 22*d* (the refrigerant may leak from the microbubble generator 22 to the outside of the boiling cooling system 1). Therefore, it is desirable to provide a valve 22*f* such as a check valve at some midpoint in the outside-air intake pipe 22*d* to prevent the refrigerant from flowing in reverse.

Figure 3:
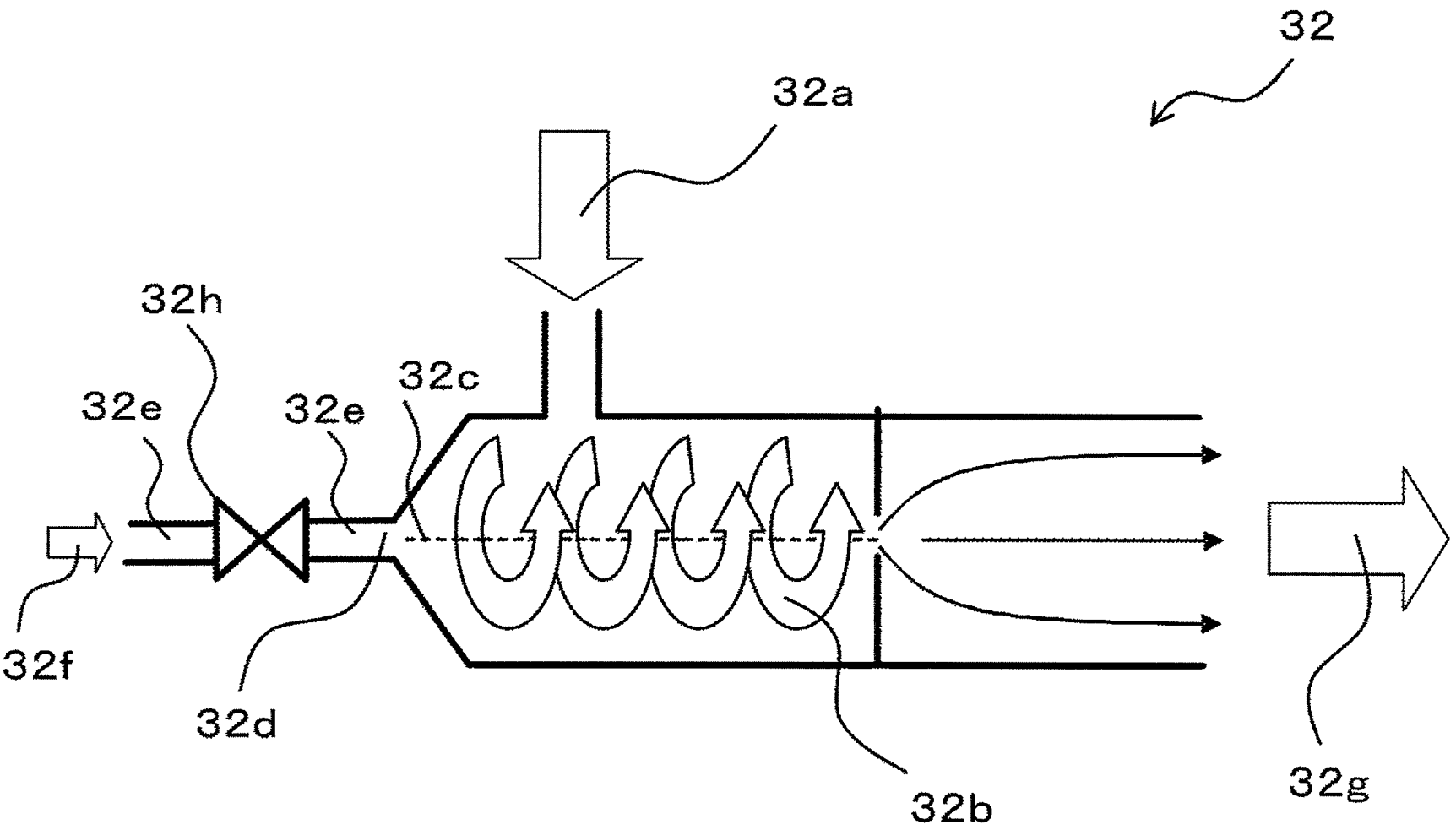
FIG. 3 is a schematic diagram of a swirling-liquid-flow-type microbubble generator.

FIG. 3 is a schematic diagram of a swirling-liquid-flow-type microbubble generator 32. The swirling-liquid-flow-type microbubble generator 32 shown in FIG. 3 produces strong swirling flow inside the microbubble generator 32. Therefore, the refrigerant flows into the microbubble generator 32 from a refrigerant inflow direction 32*a* which is almost at a right angle to a refrigerant outflow direction 32*g*. As shown in FIG. 3, after flowing in, the refrigerant swirls in a refrigerant swirl direction 32*b* about an axis in a refrigerant outflow direction 32*g*. When the refrigerant swirls in the refrigerant swirl direction 32*b*, the pressure (static pressure) is lowered at a swirl flow center 32*c* indicated by a dotted line.

A gas inlet port 32*d* is provided at a location corresponding to the swirl flow center 32*c* where the static pressure is lowered. Similarly to the ejector-type microbubble generator 32, an outside-air intake pipe 32*e* is provided to the gas inlet port 32*d*. Through the outside-air intake pipe 32*e*, the surrounding gas (outside air 320 is taken into the microbubble generator 32. Then, the refrigerant is mixed with the gas taken from the surrounding to become a two-phase fluid containing microbubbles and outflows toward a refrigerant outflow direction 32*g*. Similarly to the ejector-type microbubble generator 22, it is desirable that a valve 32*h* such as a check valve be provided at some midpoint in the outside-air intake pipe 32*e* to prevent the refrigerant from flowing in reverse.

The boiling cooler 13 is supplied with the refrigerant containing the microbubbles produced in the microbubble generator 12. Also, the boiling cooler 13 is heated from the outside by the heating element 3 and the refrigerant flowing inside receives heat to boil. The boiling cooler 13 is a container which is sealed so as not to leak the refrigerant through gaps, and the boiling cooler includes an inflow port and an outlet port, which are not illustrated in the figure, to connect with other components. As shown in FIG. 1, in the boiling cooling system 1 according to Embodiment 1 of the present invention, the upstream side of the boiling cooler 13 is connected to the microbubble generator 12 through a refrigerant pipe 16; and the downstream side thereof is connected to the radiator 14 through a refrigerant pipe 16. The refrigerant pipe 16 on the upstream side is connected to the inflow port and the refrigerant pipe 16 on the downstream side is connected to the outflow port. The refrigerant containing microbubbles flows in from the inflow port side and the boiling refrigerant heated in the boiling cooler 13 flows out to the outlet port side.

Note here that the heating element 3 is, for example, a power module such as an SiC, or an electronic device such as a control circuit, a drive circuit, a condenser, a step-down converter or a reactor. The boiling cooling system 1 is, for example, a power converter such as an inverter or a DC-DC converter which includes the above-described heating element 3, installed in an electric car, a hybrid car, etc. Furthermore, different from the boiling cooling system 1, the heating element 3 may be, for example, a heat exchanger on a heat exhaustion side and is not limited thereto.

When the heating element 3 performs its designated function, it produces heat as energy loss. The heating element 3 is provided on an outer surface of a wall of the boiling cooler 13 and heats the refrigerant via the wall surface. Note that heat dissipation fins may be provided on an inner wall surface of the boiling cooler 13 in order to promote heat transfer from the heating element 3 to the refrigerant. In order to promote boiling by utilizing microbubbles as the foam nucleuses, it is desirable that arrangement be made so that the microbubbles will easily attach to a heat transfer wall where the heating element 3 is provided. For example, the heating element 3 may be provided on top of the boiling cooler 13 so that the microbubbles will easily attach to the heat transfer wall utilizing the microbubbles' buoyancy. In that case, for example, the heat transfer wall of the boiling cooler 13 may be tilted from the horizontal so that the boiling cooler 13 can easily discharge the boiling bubbles.

The radiator 14 cools the refrigerant which has been heated by the heating element 3 and boiled in the boiling cooler 13. The radiator 14 is arranged in order that the refrigerant will be cooled after the refrigerant is boiled but before the pump 11 takes the refrigerant in. As shown in FIG. 1, in the boiling cooling system 1 according to Embodiment 1 of the present invention, the upstream side of the radiator 14 is connected to the boiling cooler 13 through a refrigerant pipe 16; and the downstream side thereof is connected to the gas-liquid separator 15 through a refrigerant pipe 16.

The radiator 14 is, for example, of a natural air cooling type or a forced air cooling type; the radiator 14 may also be a heatsink to release heat to surrounding air, a radiator in which heat dissipation fins are highly integrated, or the like. The radiator 14 may be connected to a heat pipe or a heat exchanger to transfer the refrigerant heat to a place away from the radiator 14 and release the heat there.

The gas-liquid separator 15 separates the circulating refrigerant into gas and liquid. Gas such as air is non-condensable; therefore, the gas does not condense even when cooled in the radiator 14. Therefore, the gas-liquid separator 15 is arranged in order that, after the refrigerant is boiled but before the pump 11 takes the refrigerant in, the gas-liquid separator 15 will separate gas from the refrigerant to supply the pump 11 with liquid refrigerant. This is because the gas-containing refrigerant flowing into the pump 11 may cause the refrigerant to circulate not properly in the boiling cooling system 1 due to lowering the capacity of the pump 11, or may damage the pump 11.

Also, the gas-liquid separator 15 is a container to contain the refrigerant and gas separated from the refrigerant, and a portion to contain the separated gas is especially referred to as a gas container 15*a*. The gas-liquid separator 15 is provided with an inflow port, an outflow port and an exhaust port, which are not illustrated in the figure. The inflow port and the outflow port are each connected to a refrigerant pipe 16, through which the gas-liquid separator 15 is connected to other components. Also, the exhaust port is connected to an exhaust pipe 17, through which the gas-liquid separator 15 is connected to the outside. As shown in FIG. 1, in the boiling cooling system 1 according to Embodiment 1 of the present invention, the upstream side of the gas-liquid separator 15 is connected to the radiator 14 through a refrigerant pipe 16; and the downstream side thereof is connected to the pump 11 through a refrigerant pipe 16.

In the gas-liquid separator 15 according to Embodiment 1 of the present invention, the refrigerant condenses in the radiator 14 but non-condensable gas derived from microbubbles does not condense. Therefore, from the inflow port of the gas-liquid separator 15, two-phase flow state refrigerant (refrigerant containing microbubbles) flows in from the upstream side via the refrigerant pipe 16. Also, from the outflow port of the gas-liquid separator 15, refrigerant (liquid refrigerant) produced by separating gas from the two-phase flow state refrigerant is transferred to the downstream side via the refrigerant pipe 16.

The exhaust port is a port to exhaust gas separated from the refrigerant, to which the exhaust pipe 17 is connected. The exhaust pipe 17 connected to the exhaust port is provided with a relief valve 15*b*. By opening the relief valve 15*b*, the gas such as air taken into the microbubble generator 12 can be discharged from the exhaust port to the outside. Also, even when the refrigerant volume varies due to temperature change to thereby produce pressure fluctuations inside the gas-liquid separator 15, the pressure fluctuations can be absorbed by using the relief valve 15*b*. The gas-liquid separator 15 may also function as a reservoir. Also, another port may be provided for injecting the refrigerant.

The refrigerant pipes 16 are composed of seal pipes with a straight shape, bent shape, T-shape or any combination thereof, and formed from metal, rubber, resin or the like. In the inside of the refrigerant pipes 16, a refrigerant in liquid state or a refrigerant in a two phase state of gas and liquid flows.

Next, explanation will be made about the operation of the boiling cooling system 1 according to Embodiment 1 of the present invention. Arrows 20 in FIG. 1 indicate the refrigerant's circulation direction. In the boiling cooling system 1 according to Embodiment 1 of the present invention, the refrigerant circulates through the refrigerant pipes 16 in the order the pump 11, the microbubble generator 12, the boiling cooler 13, the radiator 14, and the gas-liquid separator 15.

Explanation will be made about the refrigerant circulation in the boiling cooling system 1. The pressure of the refrigerant is increased in the pump 11, and then, the refrigerant is discharged to the microbubble generator 12. Microbubbles are added to the refrigerant having flowed into the microbubble generator 12, and then the refrigerant is transferred to the boiling cooler 13. The refrigerant having flowed into the boiling cooler 13 receives heat from the heating element 3 provided to the boiling cooler 13 and thereby boils. The boiling refrigerant flows into the radiator 14 to condense and release heat. Then, the refrigerant flows into the gas-liquid separator 15 from the radiator 14 to be separated into gas (non-condensable gas) and liquid. And then, the liquid portion is transferred, as refrigerant, to the pump 11, which thereby completes the refrigerant circulation in the boiling cooling system 1.

Here, in a case where the refrigerant temperature in the boiling cooler 13 is below the boiling point, the heat from the heating element 3 is consumed for raising the refrigerant temperature. On the other hand, in a case where the refrigerant temperature in the boiling cooler 13 is the boiling point or above, the heat from the heating element 3 is normally consumed as latent heat to change the refrigerant's phase. Therefore, when the refrigerant further receives heat from the heating element 3 after reaching the boiling point temperature, a boiling phenomenon to change phases from liquid to gas occurs to produce vapor bubbles.

In the boiling cooling system 1 according to Embodiment 1 of the present invention, the microbubble generator 12 adds microbubbles to the refrigerant, and then the microbubbles adhere to the heat transfer surface inside the boiling cooler 13. The microbubbles serve as foam nucleuses which are origins to produce vapor bubbles, to activate vapor bubble production, or to promote boiling. Then, the boiling refrigerant is transferred to the radiator 14, and the boiling refrigerant condenses in the radiator 14 to release heat to the outside. Also, in the gas-liquid separator 15, the non-condensable gas derived from microbubbles is separated as gas, and the liquid refrigerant is circulated by the pump 11.

Figure 4:
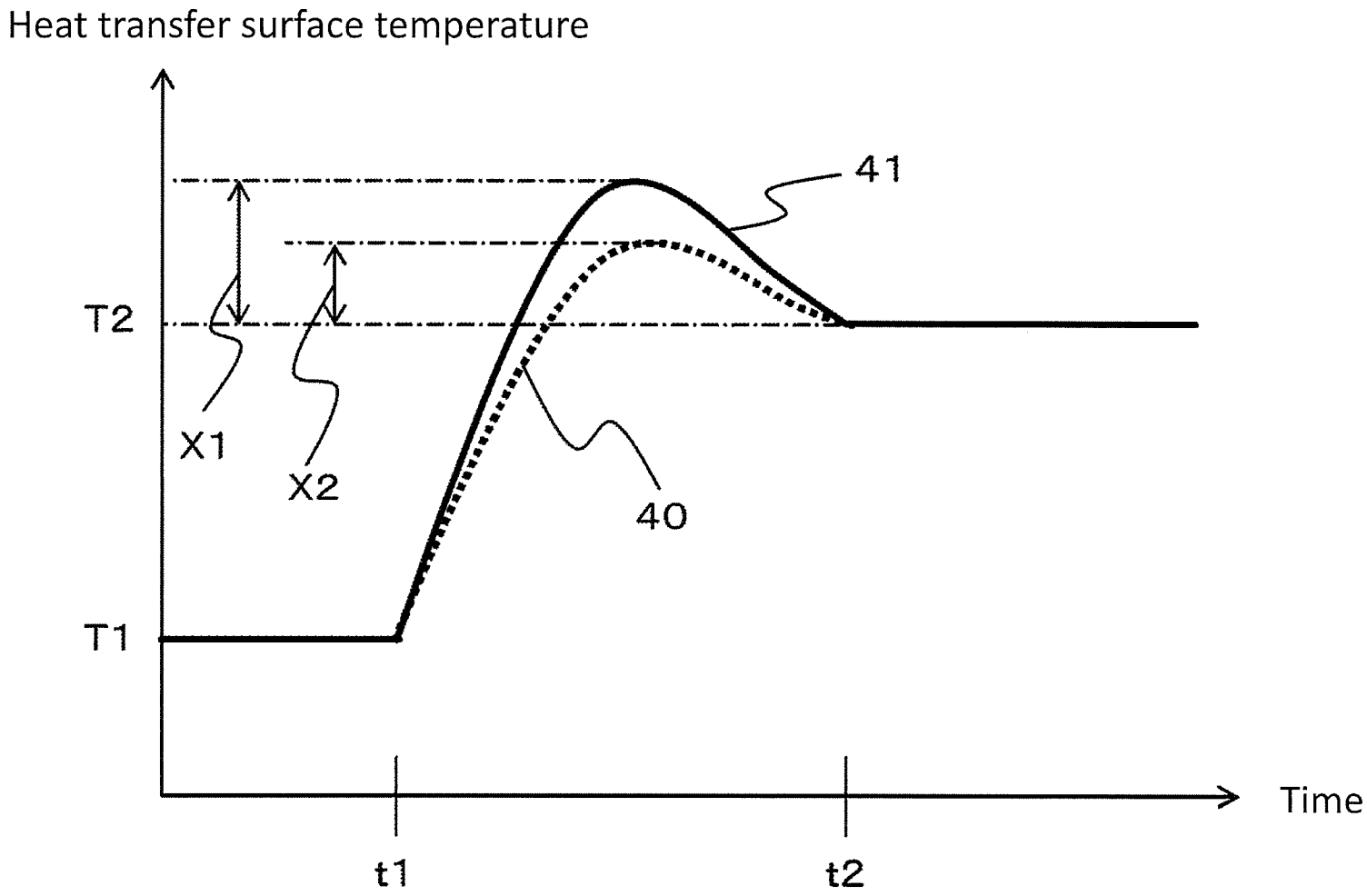
FIG. 4 is a schematic graph showing temperature transitions of a heat transfer surface of a boiling cooler.

Here, explanation will be made about overshooting in the boiling phenomenon. FIG. 4 is a schematic graph showing temperature transition of a heat transfer surface of the boiling cooler 13. The vertical axis represents heat transfer surface temperature (wall surface temperature) of the boiling cooler 13 to which the heating element 3 is provided; and the horizontal axis represents time. A dotted line graph 40 in the figure indicates transition of the heat transfer surface temperature in a case where the microbubble generator 12 produces microbubbles in the boiling cooling system 1 according to Embodiment 1 of the present invention. On the other hand, a solid line graph 41 indicates transition of the heat transfer surface temperature in a case where the microbubble generator 12 does not produce microbubbles in the boiling cooling system 1 according to Embodiment 1 of the present invention.

In FIG. 4, time t1 is the start time of heating the heating element 3; and T1 is the heat transfer surface temperature at time t1. Also, T2 is the heat transfer surface temperature at which the refrigerant obtains a degree of superheat to keep boiling, and which is higher than the refrigerant's boiling point (saturation temperature). After time t2, the boiling cooling system 1 is in a steady state and the heat transfer surface temperature is T2.

After heating by the heating element 3 starts at time t1, temperatures indicated by the solid line graph 41 and the dotted line graph 40 in the figure rise. And then, even after the heat transfer surface temperature reaches T2, each of the temperatures indicated by the solid line graph 41 and the dotted line graph 40 keeps rising to overshoot. This is because, even after the heat transfer surface temperature reaches T2, the refrigerant is still in a superheat state in which boiling does not start and the refrigerant remains in a liquid phase state. Then, the boiling phenomenon is sufficiently promoted in a little while, to cause the heat transfer surface temperature to be decreased again to T2, allowing the refrigerant to keep boiling.

Here, the solid line graph 41 and the dotted line graph 40 will be compared. In the heat transfer surface temperature shown by the solid line graph 41, let the temperature difference between the maximum value and T2 (overshoot amount) be X1; and in the heat transfer surface temperature shown by the dotted line graph 40, let the temperature difference between the maximum value and T2 (overshoot amount) be X2. As described above, by supplying the boiling cooler 13 with the refrigerant containing microbubbles, the microbubbles can function as the foam nucleuses to promote boiling. Therefore, when comparing X1 and X2, X2 indicated by the graph 40 corresponding to a case where the boiling cooler 13 is supplied with the microbubbles-containing refrigerant takes a smaller value than X1.

Therefore, the overshoot amount in a case where the boiling cooler 13 is supplied with microbubbles-containing refrigerant is smaller than that in a case where the boiling cooler 13 is supplied with the refrigerant not containing microbubbles. Because the overshoot amount can be reduced, the heating element 3 can be suitably cooled and easily kept below an allowable temperature.

In addition, the boiling cooling system 1 according to Embodiment 1 of the present invention can be applied to heating elements 3 installed in motor vehicles, electric trains, bullet trains (Shinkansen), FA (Factory Automation) machines, or the like, and applications are not limited to these.

Here, conventional techniques for boiling promotion will be explained. There is a conventional device in which cavities (for example, reentrant-type cavity) are provided for boiling promotion on the heat transfer surface of the boiling cooler 13, for example as described in Patent Document 1. The cavities are plural fine spaces with unevenness formed on the heat transfer surface to hold gas such as air. In a conventional device, when the refrigerant is heated, gas such as air caught in the cavities functions as the foam nucleuses to promote vapor bubbles' growth.

Also, a number of processing techniques to form a porous layer with cavities on the heat transfer surface have been proposed. Among the processing techniques to form a porous layer with cavities on the heat transfer surface, there are a method of baking and solidifying metal powder to produce sintered metal and a method of processing surfaces by thermal spraying.

Next, an impurity precipitation phenomenon accompanying the boiling will be explained. When a vapor bubble is produced in boiling phenomenon, there is a large density difference between the internal gas thereof and the external liquid thereof. Therefore, lifting force or buoyancy is applied to the vapor bubble. The larger the vapor bubble's volume becomes by heating, the lifting force or buoyancy increases. Then, the vapor bubble departs upward from the heat transfer surface and moves upward in the liquid. If a slightest piece of gas (vapor bubble fragment) is left on the heat transfer surface when the vapor bubble departs, this means that a foam nucleus exists on the heat transfer surface. Then, the foam nucleus left on the heat transfer surface grows again to become a large vapor bubble. The continuous occurrence of the vapor bubbles' growth leads to active boiling.

However, there are cases in which the refrigerant component or the like to be boiled is insufficiently checked, or it is impossible to check it. When tap water, for example, is to be used as the refrigerant, it should be noted that it normally contains impurities such as chlorine. Then, when a vapor bubble grows, only water component in the cooling water (refrigerant) containing impurities changes its phase into vapor at the gas-liquid interface of the vapor bubble. This causes the impurity concentration phenomenon. Even if the impurity amount is small, the concentration phenomenon increases the impurity concentration, which may cause the impurities to be precipitated on the heat transfer surface.

Then, the precipitated impurities fill the cavities on the heat transfer surface and, further, form an adhesion layer of impurities as scale on the heat transfer surface. This suppresses boiling; and an adhesion layer to be formed on the heat transfer surface has poor heat transfer performance to deteriorate the heat release characteristic. This has brought a problem in that the conventional devices may sometimes fail to sufficiently cool the heating element 3, and fail to suitably cool the heating element. To make matters worse, there has been a problem in that the precipitated impurities sometimes bond tightly to the heat transfer surface material of the boiling cooler 13, to erode the heat transfer surface depending on the kind of the material of the heat transfer surface.

As described above, the boiling cooling device 2 according to Embodiment 1 of the present invention includes: a pump 11 to circulate refrigerant; a microbubble generator 12 to produce microbubbles and incorporate the microbubbles with the refrigerant discharged from the pump 11; a boiling cooler 13 to which the refrigerant containing microbubbles is supplied and which boils the refrigerant; a radiator 14 to cool the refrigerant after the refrigerant is boiled and before the refrigerant is taken in by the pump 11; and a gas-liquid separator 15 to separate gas from the circulating refrigerant after the refrigerant is boiled and before the refrigerant is taken in by the pump 11.

Also, the boiling cooling system 1 according to Embodiment 1 of the present invention includes: a pump 11 to circulate refrigerant; a microbubble generator 12 to produce microbubbles and incorporate the microbubbles with the refrigerant discharged from the pump 11; a boiling cooler 13 to which the refrigerant containing microbubbles is supplied and which boils the refrigerant; a radiator 14 to cool the refrigerant after the refrigerant is boiled and before the refrigerant is taken in by the pump 11; a gas-liquid separator 15 to separate gas from the circulating refrigerant after the refrigerant is boiled and before the refrigerant is taken in by the pump 11; and a heating element 3 which is provided to the boiling cooler 13, to be cooled.

With such configurations described above, by supplying the microbubbles-containing refrigerant to the boiling cooler 13, it is possible to promote boiling using the microbubbles as the foam nucleuses. Also by supplying the microbubbles-containing refrigerant to the boiling cooler 13, the refrigerant can be restrained from falling into a superheat state in which the refrigerant does not start to boil and remains in a liquid phase state even at a temperature above the boiling point. Therefore, the heating element 3 can be suitably cooled to keep the temperature of the heating element 3 below an allowable temperature.

Furthermore, because the microbubbles-containing refrigerant is supplied to the boiling cooler 13 to promote boiling, a conventional process to form cavities on the heat transfer surface is not required. The cavities formed on the heat transfer surface might be filled with the precipitated impurities in a long-term use. However, even when the cavities on the heat transfer surface are filled with impurities, the microbubbles serve as the foam nucleuses to promote boiling, restraining the performance of the boiling cooling system 1 from deteriorating. Moreover, because the microbubbles have a cleaning effect, the heat transfer surface of the boiling cooler 13 is cleaned to remove the impurities, restraining the heat transfer characteristic from deteriorating. Hence, the cooling performance of the boiling cooling system 1 can be restrained from deteriorating, enabling its long time use.

Also, the boiling cooling device 2 according to Embodiment 1 of the present invention can have a configuration in which the microbubble generator 12 is a fluid-flow-type microbubble generator.

In such a configuration, by devising a suitable piping structure, microbubbles can be produced without movable parts, an electrical switching control or the like. Therefore, the power consumption can be reduced. Furthermore, because neither movable parts nor an electrical switching control is required, the possibility of failure is reduced, enhancing the reliability of the boiling cooling device. Also, because microbubbles are produced by devising a suitable piping structure, it is not needed to use electronic components requiring special attention to its heat-resistance characteristics (electronic components with low heat resistance) for producing microbubbles. Therefore, the boiling cooling device 2 with the fluid-flow-type microbubble generator has an enhanced heat resistance in comparison to the conventional devices, allowing higher-temperature refrigerant to flow through the microbubble generator 12.

Embodiment 2

A boiling cooling system 1*a* and a boiling cooling device 2*a* according to Embodiment 2 of the present invention will be explained with reference to FIG. 5. Note that, in the boiling cooling system 1 according to Embodiment 1, the gas-liquid separator 15 is provided on the downstream side of the radiator 14. In Embodiment 2 of the present invention, explanation will be made about a modification example in which a gas-liquid separator 25 is provided on the downstream side of the boiling cooler 13 and on the upstream side of the radiator 14. The different points from Embodiment 1 will be mainly explained, to appropriately omit explanations for the same or corresponding components.

Figure 5:
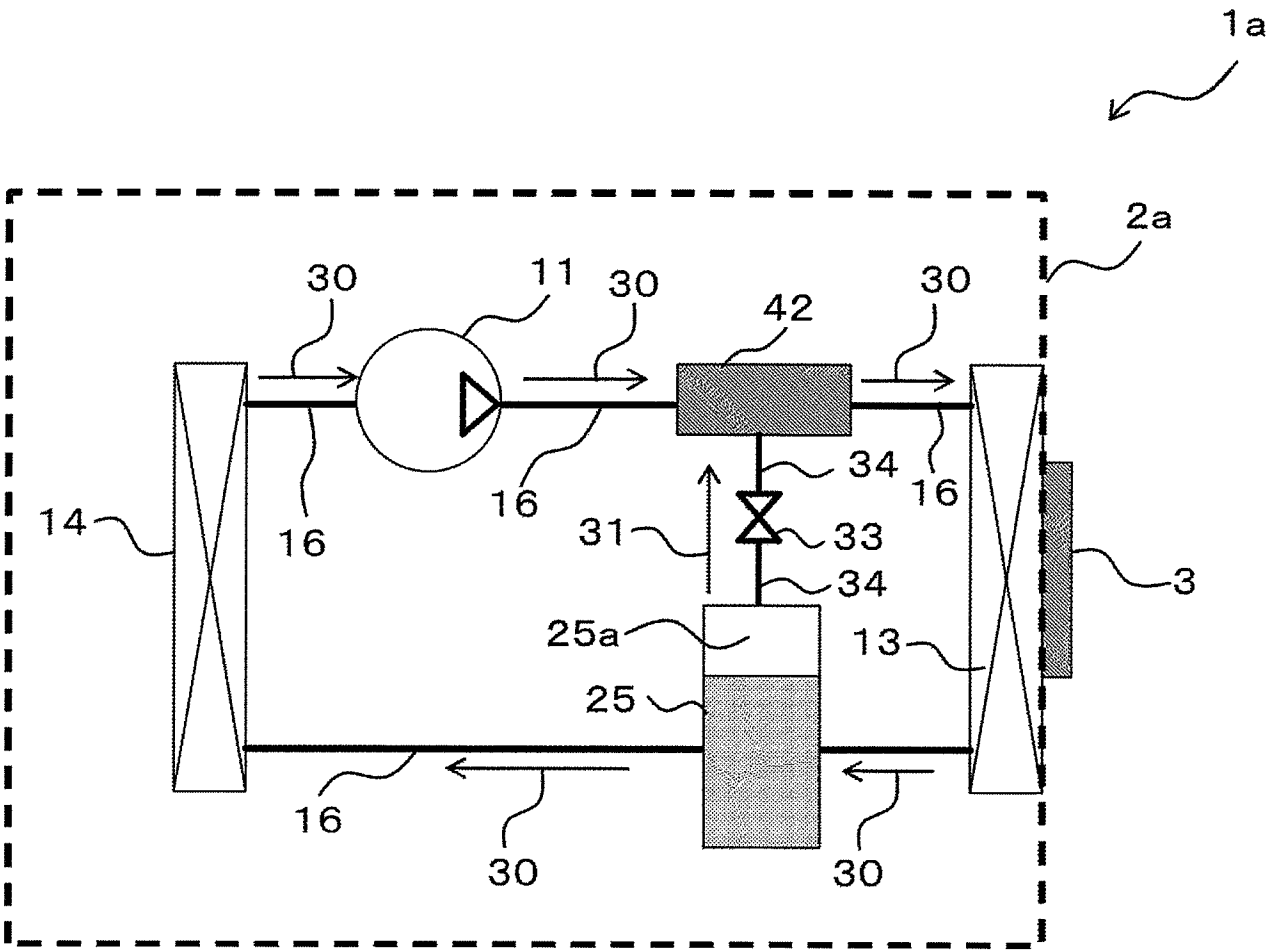
FIG. 5 is a schematic diagram of a boiling cooling system according to Embodiment 2 of the present invention.

FIG. 5 is a schematic diagram of the boiling cooling system 1*a* according to Embodiment 2 of the present invention. As shown in FIG. 5, in the boiling cooling system 1*a* according to Embodiment 2 of the present invention, the gas-liquid separator 25 is provided on the downstream side of the boiling cooler 13 and on the upstream side of the radiator 14. A gas container 25*a* containing gas separated in the gas-liquid separator 25 and a microbubble generator 42 are connected via a connecting pipe 34. The connecting pipe 34 is formed using material similar to that for the refrigerant pipe 16 explained in Embodiment 1; the connecting pipe 34 is connected at its one end to an exhaust port of the gas-liquid separator 25, and is connected at another end to a gas inlet port of the microbubble generator 42.

Next, explanation will be made about the operation of the boiling cooling system 1*a* according to Embodiment 2 of the present invention. Arrows 30 shown in FIG. 5 indicate circulation directions of the refrigerant. As shown in FIG. 5, in the boiling cooling system 1*a* according to Embodiment 2 of the present invention, the refrigerant is discharged from the pump, and then the refrigerant flows through in the order the microbubble generator 42, the boiling cooler 13, the gas-liquid separator 25, and the radiator 14 via the refrigerant pipes 16, and is taken again into the pump to complete a cycle of circulation.

In the boiling cooler 13, the refrigerant containing microbubbles is heated to boil, and the boiling refrigerant flows into the gas-liquid separator 25. In the gas-liquid separator 25, the refrigerant is separated into gas and liquid. Here, the boiling cooling system 1*a* according to Embodiment 2 of the present invention uses a fluid-flow-type microbubble generator as the microbubble generator 42. As explained in Embodiment 1 of the present invention, when a fluid-flow-type microbubble generator of a swirling-liquid-flow type or an ejector type is used, the static pressure value drops more at the gas inlet ports 22*c* and 32*d* of the fluid-flow-type microbubble generator than at the exhaust port of the gas-liquid separator 25. Therefore, the gas separated in the gas-liquid separator 25 flows from the gas-liquid separator 25 toward the microbubble generator 42 (a gas intake direction indicated by an arrow 31 in FIG. 5), and is mixed with the refrigerant discharged from the pump 11 to become microbubbles-containing refrigerant, which is supplied to the boiling cooler 13.

Note that the boiling cooling system 1*a* according to Embodiment 2 of the present invention does not use external gas, but uses the gas separated in the gas-liquid separator 25 in order to produce microbubbles. In the boiling cooling system 1*a* according to Embodiment 2 of the present invention, the exhaust port of the gas container 25*a* in the gas-liquid separator 25 and the gas inlet port of the microbubble generator 42 are connected via the connecting pipe 34. Therefore, the refrigerant circulation path has a structure sealed from the outside. Therefore, there is no concern of refrigerant leakage to and impurity contamination from the outside.

It is desirable that the microbubbles be non-condensable gas (gas such as Nitrogen, carbon dioxide or air that does not condense in an operation temperature range of the boiling cooling system 1*a*). If the microbubbles are bubbles of the refrigerant vapor, they may be partially condensed to disappear before supplied to the boiling cooler 13. Therefore, the microbubbles of non-condensable gases can be supplied to the boiling cooler 13 more securely than the microbubbles of the refrigerant vapor. The microbubbles of non-condensable gas does not necessarily have to be purely composed of non-condensable gas, and may contain some refrigerant vapor.

Note that, in charging the boiling cooling system 1*a* with the refrigerant, air mixes in the refrigerant as long as no special measure (for example, evacuation) is taken. In other words, even if source gas for the microbubble is not additionally injected into the boiling cooling system 1*a*, it is possible to charge the gas. On the other hand, a bypass pipe (not illustrated) communicating with the outside may be provided at a portion of the refrigerant circulation path, to have a semi-sealed piping configuration. With such a configuration, the source gas for the microbubbles can be easily supplied to the boiling cooling system 1*a* from outside.

Note that, in the boiling cooling system 1*a* according to Embodiment 2 of the present invention, refrigerant such as R410, R407, ammonia, ethanol, CFC, or carbon dioxide can be used in addition to the refrigerants described in Embodiment 1.

Also, the connecting pipe 34 connecting the gas inlet port of the microbubble generator 42 and the exhaust port of the gas container 25*a* containing gas separated in the gas-liquid separator 25 may be provided with a valve 33 to adjust the flow rate of gas flowing in the connecting pipe 34. By adjusting the opening degree of the valve 33, the amount of gas flowing from the gas-liquid separator 25 to the microbubble generator 42 can be adjusted. That is, by adjusting the opening degree of the valve 33, the microbubble production amount can be adjusted.

Also, the gas-liquid separator 25 may be configured so that the inflow port on its upstream side is connected to the radiator 14 via the refrigerant pipe 16 and the outflow port on its downstream side is connected to the pump 11 via the refrigerant pipe 16. In other words, the gas-liquid separator 25 may be configured in such a way that the gas-liquid separator 15 shown in FIG. 1 is connected to the gas inlet port of the microbubble generator 42 using the exhaust pipe 17 as a connecting pipe.

As described above, the boiling cooling system 1*a* according to Embodiment 2 of the present invention is characterized in that the connecting pipe 34 is provided to connect the gas inlet port of the microbubble generator 42 and the exhaust port of the gas container 25*a* containing gas separated in the gas-liquid separator 25.

With such a configuration, the gas separated in the gas-liquid separator 25 is utilized for the gas for producing microbubbles in the microbubble generator 42, therefore, there is no need to take gas in from outside. Thus, the refrigerant's circulation path can have a sealed structure. Therefore, the chances to leak the refrigerant outside can be significantly reduced, and the chances to mix outside impurities such as foreign substances into the refrigerant can be significantly reduced as well. Also, because the refrigerant-impurity mixture caused by taking air in from the surrounding can be prevented, the boiling cooling system 1*a* according to Embodiment 2 of the present invention can prevent impurities from precipitating onto the heat transfer surface of the boiling cooler 13 even in long-term use. Thus, the scales adhered onto the heat transfer surface of the boiling cooler 13 can be reduced, expending the life of the boiling cooling system 1*a*.

In the boiling cooling system 1*a* according to Embodiment 2 of the present invention, the boiling refrigerant in the boiling cooler 13 flows into the gas-liquid separator 25 before flowing through the radiator 14. Then, the boiling refrigerant is separated into gas and liquid in the gas-liquid separator 25 and the separated gas is absorbed into the microbubble generator 42. The gas absorbed into the microbubble generator 42 is not cooled by the radiator 14, the temperature of the gas is higher than that of the gas outside the boiling cooling system 1*a*. Consequently, the microbubble generator 42 supplies the boiling cooler 13 with the refrigerant containing microbubbles produced using high temperature gas, which thereby can further promote boiling in the boiling cooler 13.

In the boiling cooling system 1*a* according to Embodiment 2 of the present invention, the microbubbles may be non-condensable gas.

In this configuration, the microbubbles do not condense because they are non-condensable gas; therefore, more microbubbles can be supplied to the boiling cooler 13 than in the case where the microbubbles are of the refrigerant vapor.

In addition, because the refrigerant boiled in the boiling cooler 13 flows into the gas-liquid separator 25 before flowing through the radiator 14, the non-condensable gas derived from microbubbles can be restrained from stagnating in the radiator 14. Consequently, inhibition of heat release or flowing caused by the non-condensable gas stagnation in the radiator 14 can be suppressed, and therefore a more stable boiling cooling system 1*a* can be provided.

In the boiling cooling system 1*a* according to Embodiment 2 of the present invention, the connecting pipe 34 may be provided with the valve 33 to adjust the flow rate.

With such a configuration, the production amount of microbubbles can be adjusted, and the heat release characteristic of the boiling cooling system 1*a* can be varied in accordance with usages and conditions, to improve its cooling efficiency.

Within the scope of the present invention, it is possible to freely combine the embodiments, and properly modify or omit the embodiments.

DESCRIPTION OF SYMBOLS

1: boiling cooling system
2: boiling cooling device
3: heating element
11: pump
12, 22, 32, 42: microbubble generator
13: boiling cooler
14: radiator
15, 25: gas-liquid separator
15*a*, 25*a*: gas container
16: refrigerant pipe
22*c*, 32*d*: gas inlet port
33: valve
34: connecting pipe

The invention claimed is:

1. A boiling cooling device comprising:
a pump to circulate refrigerant;
a microbubble generator to produce microbubbles and incorporate the microbubbles into the refrigerant discharged from the pump;
a boiling cooler to which the refrigerant containing the microbubbles is supplied and which boils the refrigerant;
a radiator to cool the refrigerant after the refrigerant is boiled and before the refrigerant is taken in by the pump; and
a gas-liquid separator to separate gas from the circulating refrigerant after the refrigerant is boiled and before the refrigerant is taken in by the pump,
wherein the microbubble generator is a fluid flow type microbubble generator, taking in gas via an intake port by using liquid flow force to produce microbubbles,
wherein the gas liquid separator includes an exhaust port to exhaust gas, and
wherein gas which is not made from the refrigerant, flows from the intake port to the exhaust port.

2. The boiling cooling device according to claim 1, wherein the microbubbles are non-condensable gas.

3. The boiling cooling device according to claim 1, further comprising a connecting pipe to connect a gas inlet port of the microbubble generator and an exhaust port of a gas container containing the gas separated in the gas-liquid separator.

4. The boiling cooling device according to claim 3, wherein the connecting pipe comprises a valve to adjust a flow rate.

5. A boiling cooling system comprising:
a boiling cooling device according to claim 1; and
a heat producing device to be cooled in thermal contact with the boiling cooler.

6. A boiling cooling system comprising:
a boiling cooling device according to claim 2; and
a heat producing device to be cooled in thermal contact with the boiling cooler.

7. A boiling cooling system comprising:
a boiling cooling device according to claim 3; and
a heat producing device to be cooled in thermal contact with the boiling cooler.

8. A boiling cooling system comprising:
a boiling cooling device according to claim 4; and
a heat producing device to be cooled in thermal contact with the boiling cooler.

* * * * *